United States Patent [19]

Warner

[11] Patent Number: 4,915,146

[45] Date of Patent: Apr. 10, 1990

[54] MEASURING FLASK FOR USE IN A FILLING MACHINE

[75] Inventor: Graeme W. Warner, Hinsdale, Ill.

[73] Assignee: John R. Nalbach Engineering Co., Inc., Cicero, Ill.

[21] Appl. No.: 322,417

[22] Filed: Mar. 10, 1989

Related U.S. Application Data

[63] Continuation-in-part of Ser. No. 167,389, Mar. 14, 1988, abandoned.

[51] Int. Cl.[4] ..... B65B 1/22

[52] U.S. Cl. ..... 141/144; 141/148; 141/374

[58] Field of Search ..... 141/144–152, 141/163, 177, 181, 182, 250, 251, 263, 374, 392

[56] References Cited

U.S. PATENT DOCUMENTS

| | | | |
|---|---|---|---|
| 1,881,106 | 10/1932 | Vogt et al. | 141/263 X |
| 3,068,911 | 12/1962 | Hoyer | 141/182 |
| 3,951,186 | 4/1976 | Mencacci | 141/5 |
| 3,967,659 | 7/1976 | Warner et al. | 141/374 |
| 3,967,662 | 7/1976 | Warner | 141/148 |
| 3,978,900 | 9/1976 | Mencacci et al. | 141/374 X |
| 4,122,876 | 10/1978 | Nalbach | 141/177 |

FOREIGN PATENT DOCUMENTS

| | | | |
|---|---|---|---|
| 689889 | 10/1979 | U.S.S.R. | 141/182 |

*Primary Examiner*—Ernest G. Cusick
*Attorney, Agent, or Firm*—Anthony S. Zummer

[57] ABSTRACT

An improved measuring flask is used in a filling apparatus for filling like containers with a like measured amount of divided matter. The filling apparatus includes a housing with a drive mounted in the housing. A filling turret is mounted in the housing and has a rotatable portion driven by the drive. The filling turret includes a filling tank. The tank has a rotatable floor connected to the drive for rotating with the rotatable portion of the filling turret. A plurality of measuring flasks is mounted on the rotatable floor and arranged in a circle concentric with the circle of rotation of the rotating portion of the filling turret. Each of the measuring flasks of the plurality of flasks is connected to the rotatable floor of the filling tank for receiving divided matter from the filling tank. Each of the measuring flasks includes an open ended tube having one end opening into the filling tank. A sleeve is telescopically mounted on each tube and is movable axially along the respective tube. Each of the sleeves has one end engageable with an interior of a bottom of a container which container receives a measured amount of divided matter from the respective measuring flask. Each of the sleeves being limited in downward movement relative to the respective tube allowing free movement of the sleeve until limited in downward movement or engagement with an interior of a bottom of a container.

13 Claims, 3 Drawing Sheets

MEASURING FLASK FOR USE IN A FILLING MACHINE

CROSS-REFERENCE TO RELATED APPLICATION

The instant application is a continuation-in-part of patent application Ser. No. 07/167,389, filed Mar. 14, 1988, and entitled, "Improved Measuring Flask For Use In A Filling Machine", now abandoned.

BACKGROUND OF THE INVENTION

The use of machines for filling containers with free flowing powdered or granular material is well known. These powdered or granular materials include a broad range of food products, including, milk products, condiments, tea, coffee, sugar, cocoa, rice and seeds, as well as a general line of chemicals, including, cleaners, lyes, crystals, and the like. Machines of this general type have found a wide range of acceptance in the food, chemical and cosmetic industries, for packaging all manner of dry materials. A certain machine which has found wide acceptance is disclosed in U.S. Pat. No. 3,967,662, entitled, "Container Filling Apparatus", which issued July 6, 1976, wherein Graeme W. Warner, of Hinsdale, Ill. is the patentee. The operation of the patented machine has been widely accepted as being satisfactory; however, there is a problem when the machine is used with certain containers which do not have a uniform heighth from the exterior bottom portion of the container to the interior bottom portion of that container. The problem is oftentimes more pronounced with glass containers than with other containers, such as, plastic or metal containers.

Most glass containers are manufactured by a blow-molding process wherein molten glass is first placed in a parison mold for initial blowing, and then is further blown in a second mold for the final blowing of the glass container to the finished configuration. Since the container is made by a blow-molding process, the thickness of the bottom of one glass container is not always the same as the thickness of the bottom of another glass container made by the same operation at the same time. This variance in thickness of the bottom of glass containers creates a problem in filling those glass containers. The filling machine shown in Warner U.S. Pat. No. 3,967,662 may be built in any one of a number of forms wherein the machine may fill anywhere from twenty containers per minute to three hundred containers per minute, or sometimes even faster. It may be appreciated that as the speed of the filling operation is increased from one container each three seconds to one container each one-fifth of a second, the glass containers are moved up toward the measuring flasks at a rapid rate. The result is that if there is an attempt to adjust the distance between the bottom of the filling flask and the top of the conveyor carrying the containers to a point where the filling flask just touches the bottom of the container, the variance in the thickness of the bottoms of the glass container results in the bottoms of the containers striking the measuring flasks and breaking out bottoms of those containers. This is an undesired result.

In order to avoid the breaking of the bottoms of the containers, and to accommodate the varying sizes of the containers, the distance between the bottom of the measuring flask and the top of the conveyor is adjusted so that there is always a space between the bottom of the measuring flask and the top of the thickest bottom of a container. An inspection of the drawings of the aforementioned patent, especially FIGS. 1 and 5 of that patent, shows how the bottom of the flask is spaced from the bottom of the container. This results in granular material flowing out from under the bottom of the measuring flasks and over the top of the bottom. This flow of material is referred to as flushing. The amount of flushing which occurs is dependent upon the amount of space between the bottom of the flask and the top of the interior surface of the bottom. The type of material which is being filled also has an effect on the amount of flushing. It may be appreciated that in order to make certain that a container is filled with the minimum amount of material to satisfy the shown amount on a label, it is necessary to adjust the filling machine so that the full amount of material is delivered to the container when there is a minimum amount of flushing. When there is additional flushing, there is an overage of material in the container. It may further be appreciated that when there are three hundred containers per minute filled in a given machine, the overage can result in a substantial over delivery of material efficient than is desired.

The flushing problem has been with the filling industry for many years, but no satisfactory solution has been found heretofore. It is the principal object of the present invention to provide an improved measuring filling flask which eliminates the problem of flushing and allows a container to be filled with the correct amount of material.

SUMMARY OF THE INVENTION

The present invention relates to an improved measuring flask construction for use in a filling machine for filling containers with a like measured amount of divided matter. The filling machine includes a housing with a drive mounted in the housing. A filling turret is mounted in the housing, and the turret has a rotatable portion connected to the drive and is rotated thereby. The filling turret also includes a filling tank. The filling tank has a rotatable floor connected to the drive to be rotated thereby with the rotatable portion of the filling turret. A plurality of measuring flasks is mounted on the rotatable floor, and the flasks are arranged in a circle concentric with the circle of rotation of said rotatable portion of the filling turret. Each of the measuring flasks of the plurality of flasks is connected to the rotatable floor of the filling tank for receiving divided matter therefrom and measuring said matter. Each of the measuring filling flasks includes an open ended thin wall right circular tube having one end connected to the rotatable floor and opening into the interior of the filling tank. A high impact strength plastic sleeve is telescopically mounted on each tube and is freely movable axially along the respective tube. Each of said sleeves has one end engageable with the interior of a bottom of a container which container receives a measured amount of divided matter from the respective measuring flask. Means are connectable to each sleeve for limiting movement of the respective sleeve downward relative to its respective tube allowing free movement of the sleeve until connection of the means to the sleeve or the sleeve to the bottom of the respective container.

DESCRIPTION OF THE PREFERRED EMBODIMENT

Figure 1:
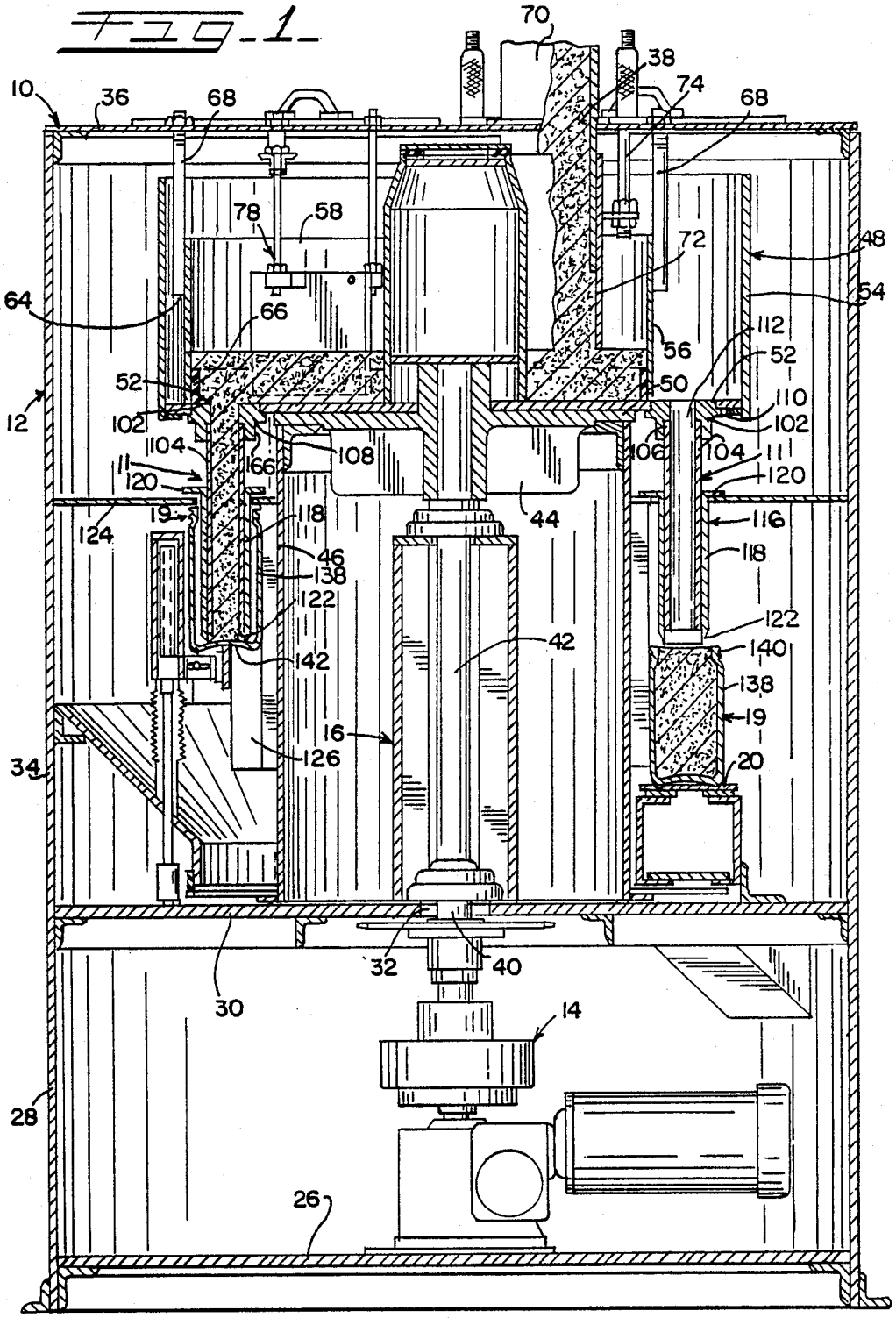
FIG. 1 is a cross sectional elevational view of a container filling apparatus including the measuring flasks embodying the herein disclosed invention.
Figure 2:
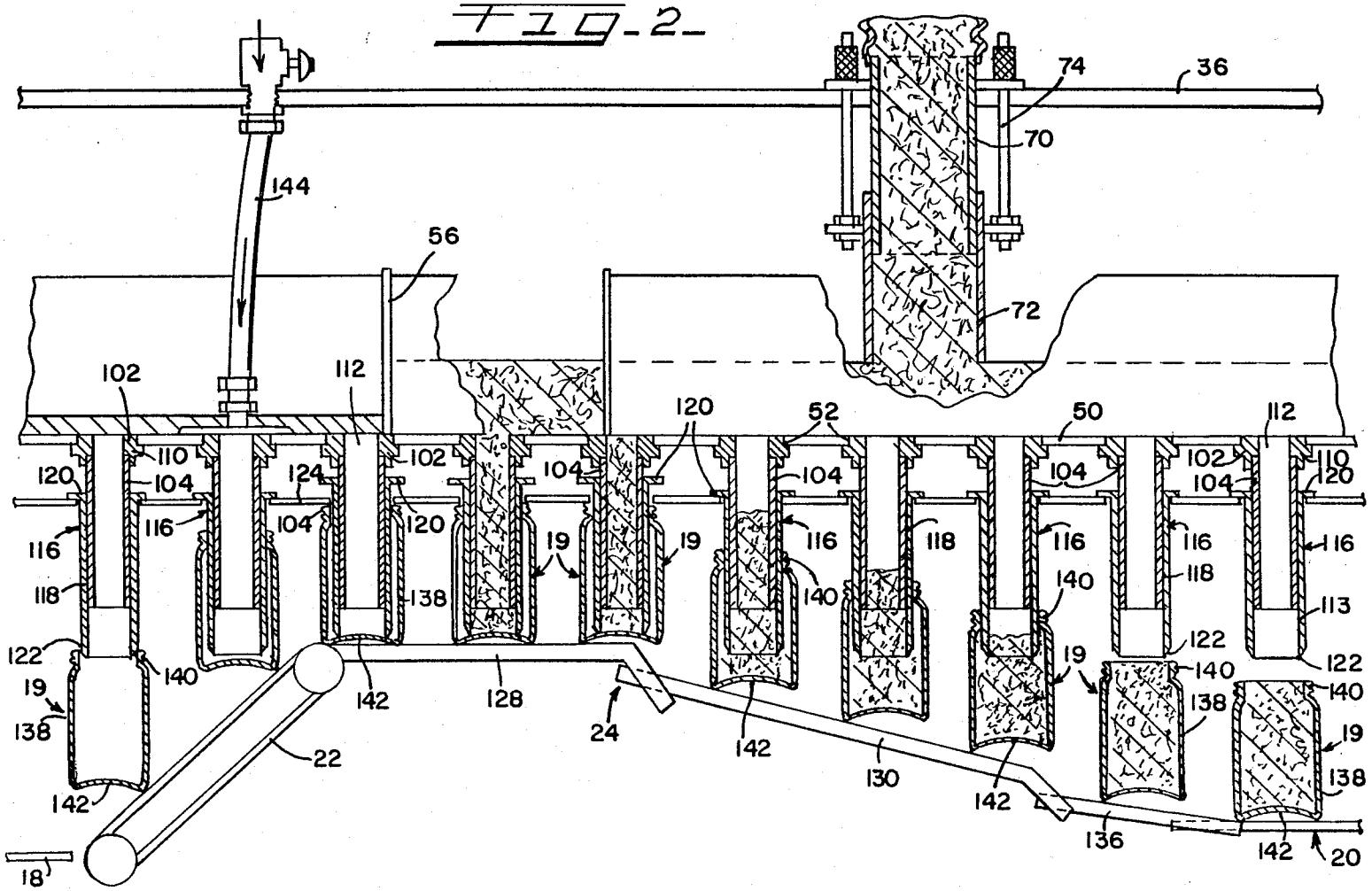
FIG. 2 is a cross sectional view through all of the stations of the filling machine of FIG. 1 but laid out flat in order to show the attitude of each measuring flask relative to the respective container at each filling station.
Figure 3:
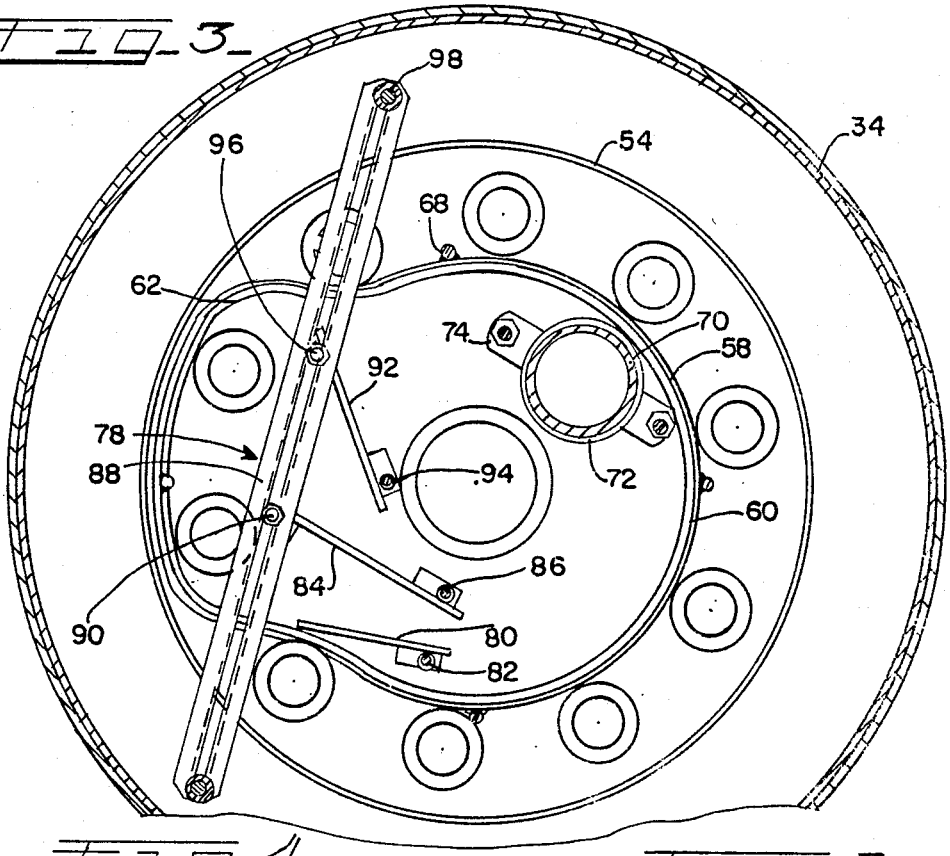
FIG. 3 is a top view of the filling machine of FIG. 1.
Figure 4:
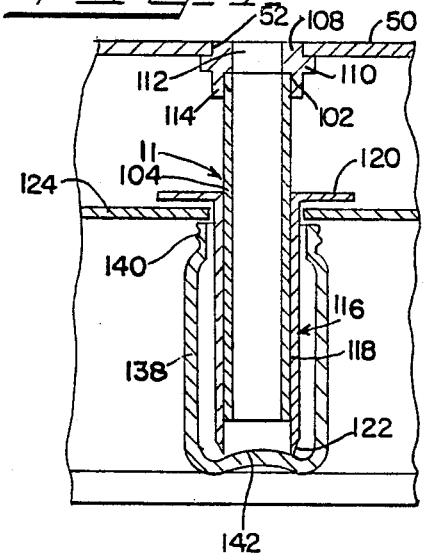
FIG. 4 is an enlarged cross sectional view of a container at one of the stations prior to introduction of divided matter into the measuring flask.
Figure 5:
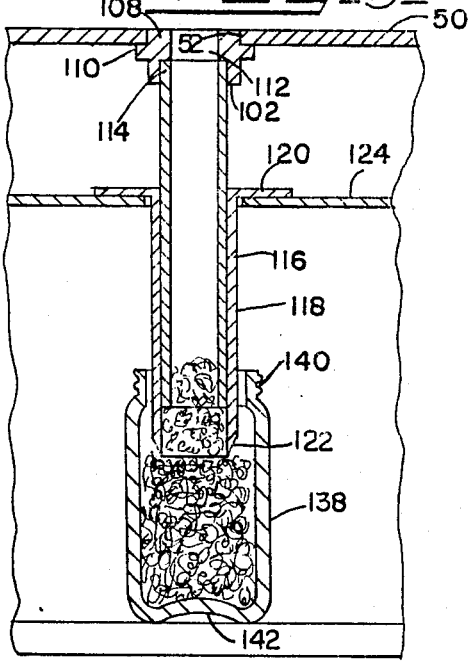
FIG. 5 is an enlarged cross sectional view similar to FIG. 4 but showing the container partially filled with some divided matter still held in the measuring flask.

Referring now to the drawings and especially to FIG. 1, a container filling apparatus 10, which is similar to the apparatus described in detail in U.S. Pat. No. 3,967,662, is shown therein with improved measuring flasks 11. Apparatus 10 generally includes a housing 12 with a conventional variable drive 14 mounted in the lower portion of the housing. A filling turret 16 is mounted in the housing. An input conveyor 18 is connected to the housing for delivering empty conventional blow molded glass containers 19 to filling turret 16. Though glass containers are disclosed herein, the containers may be made of any suitable material, such as, plastic or metal. An output conveyor 20 is positioned adjacent to the filling turret for receipt of filled containers. A container elevator 22 is mounted in the housing for raising empty containers to a sectioned container support 24.

Housing 12 generally includes a drive floor 26 which supports drive 14. A skirt 28 has its lower edge connected to drive floor 26 to enclose drive 14. A filler floor 30 is mounted on the upper portion of the skirt. The filler floor includes a drive aperture 32 in the center thereof for receiving a portion of drive 14. A filler wall 34 is connected to the skirt to form a continuous exterior housing. The housing also includes a roof 36 which has an inlet aperture 38 contained therein to provide an opening for delivering powder or granular material into the housing.

Drive 14 is a conventional and well known electric motor speed reducer combination with an output shaft 40 extending therefrom through aperture 32. Filling turret 16 includes a drive shaft 42 which is connected to shaft 40. Drive shaft 42 is drivingly connected to a hub 44 which has a drum 46 mounted on its outer periphery. A filling tank assembly 48 is mounted on the upper portion of hub 44.

Filling tank assembly 48 includes a rotatable tank floor 50 with a plurality of flask apertures 52 contained therein. Floor 50 is fixed to hub 44 to rotate with drum 46. Flask apertures 52 are arranged in a circle having the center at the center of floor 50, which center of the floor is concentric with the axis of rotation of floor 50. The filling tank assembly includes a side wall 54 which is fixed to the outer periphery of floor 50. A retainer 56 is mounted within side wall 54. The retainer has its lower edge positioned in sliding engagement with floor 50. The retainer includes a continuous wall 58 which has a central loop 60 and a filling loop 62. The retainer wall generally consists of two parts, namely, a sheet metal upper wall 64 and a resilient scraper assembly 66 connected to the lower edge of the sheet metal upper wall 64. The scraper assembly has a scraper blade which is fixed to the sheet metal wall 64 by a plurality of fasteners which are not shown herein. The scraper assembly is in scraping engagement with floor 50 to retain granulated matter within the retainer. Continuous wall 54 is suspended from roof 36 by a plurality of roof supports 68 so that the retainer is held relative to the housing while floor 50 rotates relative to the same housing.

An inlet tube 70 is positioned in inlet aperture 38 and terminates below the upper level of retainer 56, as may be best seen in FIG. 1. The upper end of inlet tube 70 is connected to a source of powdered or granulated matter, which source is not shown herein but is conventional in the art. A telescoping inlet sleeve 72 is movably mounted on inlet tube 70. The inlet sleeve 72 is connected to a plurality of sleeve adjustment rods 74 which are mounted in roof 36 to raise the lower sleeve 72 relative to floor 50 to regulate the depth of material contained in the retainer.

The filling tank assembly also includes a product guide 78 mounted within the housing. The product guide includes an outer vane 80 which is supported from roof 36 by a conventional rod 82. An adjustable center vane 84 is supported from the roof by rod 86 at one end. The other end of vane 84 is positioned on an adjustment rod or bar 88 by a fastener assembly 90, which allows the vane to be swung to a position for moving material in the filling tank. An inner vane 92 has one end pivotally connected to the roof through vane rod 94. The other end of vane 92 is connected to adjustment bar 88 by a fastener assembly 96. The adjustment bar 88 is fixed to the roof by fasteners 98.

Vertical measuring flask 11 is mounted in each of the flask apertures 52 so that the flasks are in a circle concentric with the axis of rotation of floor 50. Each of the measuring flasks includes a tube head 102 and a stainless steel open ended thin wall right circular cylindrical tube 104. Each tube head includes a head body 106 which head body includes a stanchion 108 which mates with its respective flask aperture 52. A mounting ring 110 s formed integral with body 106 to position the head so that the upper end of the head is flush with floor 50. The body includes a filling aperture 112 which is aligned with the interior of tube 104. A mounting recess 114 is formed in the lower end of the head with tube 104 mounted in the recess. Tube 104 has a smooth interior surface which is aligned to the lower portion of the filling aperture so that there is a smooth continuous surface for flow of the material from the filling aperture into the interior of the tube. Tube 104 has a smooth outer surface to receive a sleeve 116 telescopically mounted on the outer surface of tube 104. Sleeve 116 includes an open ended tubular body 118 which slideably receives tube 104. A retaining collar 120 is formed integral with one end of the tubular body 118. A beveled end 122 is formed integral with the other end of the tubular body. Sleeve 116 is made of a high impact strength plastic material, in this case, polyurethane, however, the sleeve may be made of a metal, such as, stainless steel for certain applications. Collar 120 is formed integral with tubular body 118, and the beveled end 122 is also formed integral with the tubular body. A sleeve retainer shelf 124 is mounted within the housing and is engageable with collar 120 of the sleeve to provide a means for retaining the sleeve relative to the tube in one direction, but the shelf allows the sleeve to move freely relative to the tube until the sleeve engages the shelf or the sleeve engages a container.

The filling turret includes a plurality of container pockets 126, each of which pockets is positioned adjacent to a measuring flask. Each of the pockets has walls which are mounted on drum 46 so that a container 19 positioned in one of the pockets is carried along with the drum and is raised and lowered relative to its flask as the container moves along the container support.

Container support 24 includes an upper filling section 128, a loading section 130, and a release section 136. The container support slidingly receives glass containers 19.

Each of the glass containers 19 is conventional in its construction in that it includes a cylindrical body 138 with a threaded neck 140 on its upper end and a dome shaped bottom 142. It is desirable for the glass containers to have a uniform height from the exterior of the bottom surface to the uppermost surface of the interior of the dome bottom. As a practical matter, the containers do not have absolute uniformity.

Glass containers 19 are delivered to the filling turret on the input conveyor. Each glass container is positioned in a pocket on the drum wherein each container may move vertically in its respective pocket. Each container is carried by the drum to conveyor 22 where the container is raised relative to its respective measuring flask. While the container is being raised, filling aperture 112 is aligned with a purging gas line 144 from which a purging gas, such as, nitrogen, is introduced into the container. The container is then raised to upper filling section 128 of the container support. When the container is at the upper filling section, dome bottom 142 of the glass container engages beveled edge 122 of the sleeve and pushes the sleeve upward relative to tube 104, displacing collar 120 from support 124. Free movement of sleeve 116 relative to tube 104 allows the sleeve to be positioned accurately and quickly to allow the filling machine to operate at a high rate of filling. The engagement of edge 122 with the bottom of the container creates a seal therebetween to prevent flushing. The filling aperture 112 then enters the filling tank where matter contained in the tank enters the filling aperture filling tube 104 and the portion of the sleeve between the dome shaped bottom 142 and end of tube 104. The container is carried along through the filling tank until it reaches the end of retainer 56 and there is no material to enter the tube 104. The container then drops down to loading section 130. As the container drops away from the sleeve, the material contained in the tube and the sleeve enters the container. The collar of the sleeve engages support 124 and the sleeve then is held at one level as the container drops away from the sleeve and the tube so that the matter contained in the tube and sleeve is delivered to container 19. The container then drops away from the tube and sleeve after all of the matter has been allowed to leave the tube and sleeve. The filled container is then delivered to output conveyor 20 and is carried away for capping or other operations.

From the foregoing description, it may be appreciated that flushing in the operation is eliminated since the sleeve engages the bottom of the container and the matter in the tube has no opportunity to flow out between the end of the sleeve and the bottom. By use of a high impact strength plastic which allows the sleeve to be light, the filling machine may operate at a high rate of speed and still allow the bottom of the container to engage the sleeve without damage to the bottom since the sleeve is not fixed but is freely movable axially to accommodate the variance in height of the upper portion of the bottoms of the containers.

Although a specific embodiment of the herein disclosed invention has been shown in the accompanying drawings and described in detail above, it is readily apparent that those skilled in the art may make various modifications and changes without departing from the spirit and scope of the present invention. It is to be expressly understood that the instant invention is limited only by the appended claims.

I claim:

1. In an apparatus for filling like containers with a like measured amount of divided matter having; an apparatus housing, a drive connected to said housing, a filling turret mounted in said housing, said filling turret having a rotatable portion connected to said drive, said rotatable portion being rotated by said drive, said filling turret including a filling tank, said filling tank having a rotatable floor connected to said drive, said rotatable floor rotating with said rotating portion of the filling turret, a plurality of measuring flasks arranged in a circle concentric with the circle of rotation of said rotating portion of the filling turret, each of said measuring flasks of said plurality of measuring flasks connected to said rotatable floor of the filling tank for receiving divided matter from the filling tank and measuring the amount of said matter; the improvement comprising; each of said measuring flasks including an open ended tube having one end connected to the rotatable floor and the other end extending downward, a sleeve telescopically mounted on each tube and being movable axially along the respective tube, each of said sleeves having one end adapted to be engageable with an interior at the bottom of a container while the respective measuring flask is being filled with divided matter to be delivered into the container, and means connectable to the sleeve for limiting movement of the sleeve downward relative to the tube allowing free movement of the sleeve until either connection of the means to the sleeve or the sleeve to the bottom of the container.

2. In an apparatus for filling like containers with a like measured amount of divided matter as defined in claim 1, wherein each tube is a thin wall right circular cylinder.

3. In an apparatus for filling like containers with a like measured amount of divided matter as defined in claim 1, wherein each tube is of stainless steel having a smooth interior surface and a smooth outer surface, said outer surface being slideably engageable with the respective sleeve.

4. In an apparatus for filling like containers with a like measured amount of divided matter as defined in claim 1, wherein said one end of each sleeve engageable with an interior of a bottom of a container being beveled.

5. In an apparatus for filling like containers with a like measured amount of divided matter as defined in claim 1, wherein each sleeve is an integral unit made of a single material.

6. In an apparatus for filling like containers with a like measured amount of divided matter as defined in claim 1, wherein each tube is stainless steel having a smooth interior surface and a smooth outer surface, each sleeve being slideably mounted on the smooth outer surface of its respective tube.

7. In an apparatus for filling like containers with a like measured amount of divided matter as defined in claim 1, wherein each tube is stainless steel having a smooth interior surface and a smooth outer surface, each sleeve being slideably mounted on the smooth outer surface of its respective tube, and each sleeve is constructed as a unitary part.

8. In an apparatus for filling like containers with a like measured amount of divided matter having; an apparatus housing, a drive connected to said housing, a filling turret mounted in said housing, said filling turret having a rotatable portion connected to said drive, said rotatable portion being rotated by said drive, said filling turret including a filling tank, said filling tank having a rotatable floor connected to said drive, said rotatable floor rotating with said rotating portion of the filling turret, a plurality of measuring flasks arranged in a circle concentric with the circle of rotation of said rotating portion of the filling turret, each of said measuring flasks of said plurality of measuring flasks connected to said rotatable floor of the filling tank for receiving divided matter from the filling tank and measuring the amount of said matter; the improvement comprising; each of said measuring flasks including an open ended tube having one end connected to the rotatable floor and the other end extending downward, a sleeve telescopically mounted on each tube and being movable axially along the respective tube, each of said sleeves having one end adapted to be engageable with an interior at the bottom of a container while the respective measuring flask is being filled with divided matter to be delivered into the container, each sleeve has a collar on an end of the sleeve opposite to the end engageable with a bottom of a container, and a retainer engageable with each collar for limiting downward movement of the respective sleeve relative to the respective tube.

9. In an apparatus for filling like containers with a like measured amount of divided matter having; an apparatus housing, a drive connected to said housing, a filling turret mounted in said housing, said filling turret having a rotatable portion connected to said drive, said rotatable portion being rotated by said drive, said filling turret including a filling tank, said filling tank having a rotatable floor connected to said drive, said rotatable floor rotating with said rotating portion of the filling turret, a plurality of measuring flasks arranged in a circle concentric with the circle of rotation of said rotating portion of the filling turret, each of said measuring flasks of said plurality of measuring flasks connected to said rotatable floor of the filling tank for receiving divided matter from the filling tank and measuring the amount of said matter; the improvement comprising; each of said measuring flasks including an open ended tube having one end connected to the rotatable floor and the other end extending downward, each tube is stainless steel and has a smooth interior surface and a smooth outer surface, a sleeve telescopically mounted on each tube and being movable axially along the respective tube, each sleeve being slideably mounted on the outer surface of its respective tube, each of said sleeves having one end adapted to be engageable with an interior at the bottom of a container while the respective measuring flask is being filled with divided matter to be delivered into the container, and each sleeve having a collar on an end opposite to the end engageable with a bottom of a container for limiting movement of the sleeve toward the lower end of the tube.

10. In an apparatus for filling like containers with a like measured amount of divided matter having; an apparatus housing, a drive connected to said housing, a filling turret mounted in said housing, said filling turret having a rotatable portion connected to said drive, said rotatable portion being rotated by said drive, said filling turret including a filling tank, said filling tank having a rotatable floor connected to said drive, said rotatable floor rotating with said rotating portion of the filling turret, a plurality of measuring flasks arranged in a circle concentric with the circle of rotation of said rotating portion of the filling turret, each of said measuring flasks of said plurality of measuring flasks connected to said rotatable floor of the filling tank for receiving divided matter from the filling tank and measuring the amount of said matter; the improvement comprising; each of said measuring flasks including an open ended tube having one end connected to the rotatable floor and the other end extending downward, a sleeve telescopically mounted on each tube and being movable axially along the respective tube, each of said sleeves having one end adapted to be engageable with an interior at the bottom of a container while the respective measuring flask is being filled with divided matter to be delivered into the container, each sleeve is an integral unit, each sleeve having a collar on an end opposite to the end engageable with the bottom of the container, and means connectable to each collar for limiting movement of the respective sleeve relative to the respective tube toward the lower end of the tube.

11. In an apparatus for filling like containers with a like measured amount of divided matter having; an apparatus housing, a drive connected to said housing, a filling turret mounted in said housing, said filling turret having a rotatable portion connected to said drive, said rotatable portion being rotated by said drive, said filling turret including a filling tank, said filling tank having a rotatable floor connected to said drive, said rotatable floor rotating with said rotating portion of the filling turret, a plurality of measuring flasks arranged in a circle concentric with the circle of rotation of said rotating portion of the filling turret, each of said measuring flasks of said plurality of measuring flasks connected to said rotatable floor of the filling tank for receiving divided matter from the filling tank and measuring the amount of said matter; the improvement comprising; each of said measuring flasks including an open ended tube having one end connected to the rotatable floor and the other end extending downward, each tube is a thin wall right circular cylinder, a sleeve telescopically mounted on each tube and being movable axially along the respective tube, each of said sleeves having one end adapted to be engageable with an interior at the bottom of a container while the respective measuring flask is being filled with divided matter to be delivered into the container, each sleeve has a collar on an end opposite to the end engageable with a bottom of a container, and means engageable with each collar to limit the movement of the respective sleeve relative to the respective tube in a direction toward the lower end of the tube.

12. In an apparatus for filling like containers with a like measured amount of divided matter having; an apparatus housing, a drive connected to said housing, a filling turret mounted in said housing, said filling turret having a rotatable portion connected to said drive, said rotatable portion being rotated by said drive, said filling turret including a filling tank, said filling tank having a rotatable floor connected to said drive, said rotatable floor rotating with said rotating portion of the filling turret, a plurality of measuring flasks arranged in a circle concentric with the circle of rotation of said rotating portion of the filling turret, each of said measuring flasks of said plurality of measuring flasks connected to said rotatable floor of the filling tank for receiving divided matter from the filling tank and measuring the amount of said matter; the improvement comprising; each of said measuring flasks including an open ended tube having one end connected to the rotatable floor and the other end extending downward, a sleeve telescopically mounted on each tube and being movable axially along the respective tube, each of said sleeves having one end adapted to be engageable with an interior at the bottom of a container while the respective measuring flask is being filled with divided matter to be delivered into the container, said one end of each sleeve engageable with an interior of a bottom of a container is beveled for engagement with the bottom of the container, each sleeve has a collar on an end opposite to the end engageable with the bottom of a container, and means engageable with each collar limiting movement of the respective sleeve in a direction toward the lower end of the tube.

13. In an apparatus for filling like containers with a like measured amount of divided matter having; an apparatus housing, a dive connected to said housing, a filling turret mounted in said housing, said filling turret having a rotatable portion connected to said drive, said rotatable portion being rotated by said drive, said filling turret including a filling tank, said filling tank having a rotatable floor connected to said drive, said rotatable floor rotating with said rotating portion of the filling turret, a plurality of measuring flasks arranged in a circle concentric with the circle of rotation of said rotating portion of the filling turret, each of said measuring flasks of said plurality of measuring flasks connected to said rotatable floor of the filling tank for receiving divided matter from the filling tank and measuring the amount of said matter; the improvement comprising; each of said measuring flasks including an open ended tube having one end connected to the rotatable floor and the other end extending downward, each tube is a stainless steel thin wall right circular cylinder having a smooth interior surface and a smooth outer surface, a sleeve telescopically mounted on each tube and being movable axially along the respective tube, each of said sleeves having one end adapted to be engageable with an interior of a bottom of a container while the respective measuring flask is being filled with divided matter to be delivered into the container, each sleeve being slideably mounted on the smooth outer surface of the respective tube, each sleeve being an integral unit made of a high impact strength polyurethane and having a collar on an end opposite to the end engageable with the bottom of a container, said end of each sleeve engageable with the bottom of a container being beveled on the outer surface for engagement with the bottom of a container, and means engageable with each collar limiting movement of the respective sleeve in a direction toward the bottom of a container.

* * * * *

UNITED STATES PATENT AND TRADEMARK OFFICE

CERTIFICATE OF CORRECTION

PATENT NO. : 4,915,146

DATED : April 10, 1990

INVENTOR(S) : Graeme W. Warner

It is certified that error appears in the above-identified patent and that said Letters Patent is hereby corrected as shown below:

Column 2, line 24, after material insert, "to the containers, thereby rendering the filling to be less"

Column 4, line 43, cancel "s" and substitute therefor--is--

Claim 13, line 3, cancel "dive" and substitute therefor--drive--

Signed and Sealed this

Twenty-first Day of April, 1992

*Attest:*

HARRY F. MANBECK, JR.

*Attesting Officer*

*Commissioner of Patents and Trademarks*